United States Patent [19]

von Dreusche, Jr.

[11] 4,046,086

[45] Sept. 6, 1977

[54] TREATMENT OF WASTE MATERIAL CONTAINING ALKALI METALS IN A CONTROLLED ATMOSPHERE FURNACE

[75] Inventor: Charles F. von Dreusche, Jr., Ramsey, N.J.

[73] Assignee: Nichols Engineering & Research Corporation, Belle Mead, N.J.

[21] Appl. No.: 706,638

[22] Filed: July 19, 1976

[51] Int. Cl.[2] ..... F23G 5/04

[52] U.S. Cl. ..... 110/12; 202/117; 432/139; 110/15

[58] Field of Search ..... 110/8 R, 8 C, 12, 15, 110/7 B; 432/18, 131, 139, 142; 201/44; 202/117

[56] References Cited

U.S. PATENT DOCUMENTS

| | | | |
|---|---|---|---|
| 2,144,507 | 1/1939 | Raigch | 110/12 |
| 3,047,362 | 7/1962 | Smith | 110/7 |
| 3,958,920 | 5/1976 | Anderson | 432/139 |
| 3,968,756 | 7/1976 | Yamada | 110/12 |

*Primary Examiner*—Kenneth W. Sprague
*Attorney, Agent, or Firm*—Edwin T. Grimes

[57] ABSTRACT

The invention is directed to method and apparatus for treating waste material containing alkali metal in a counter-flow furnace wherein the waste material to be processed is introduced at one end thereof and the processed material is discharged from the other end, while simultaneously air is introduced and the gases of combustion are caused to flow in a counter-current direction with respect to the material being processed and are exhausted at the first end of the furnace, and wherein the furnace has a natural tendency to form zones of processing including sequentially from the first end of the furnace, a drying zone, a charring and volatile burning zone, and a fixed carbon burning zone, and wherein a maximum temperature is maintained in the furnace below about 1400° F. directly adjacent the surface of the bed of material being processed.

10 Claims, 1 Drawing Figure

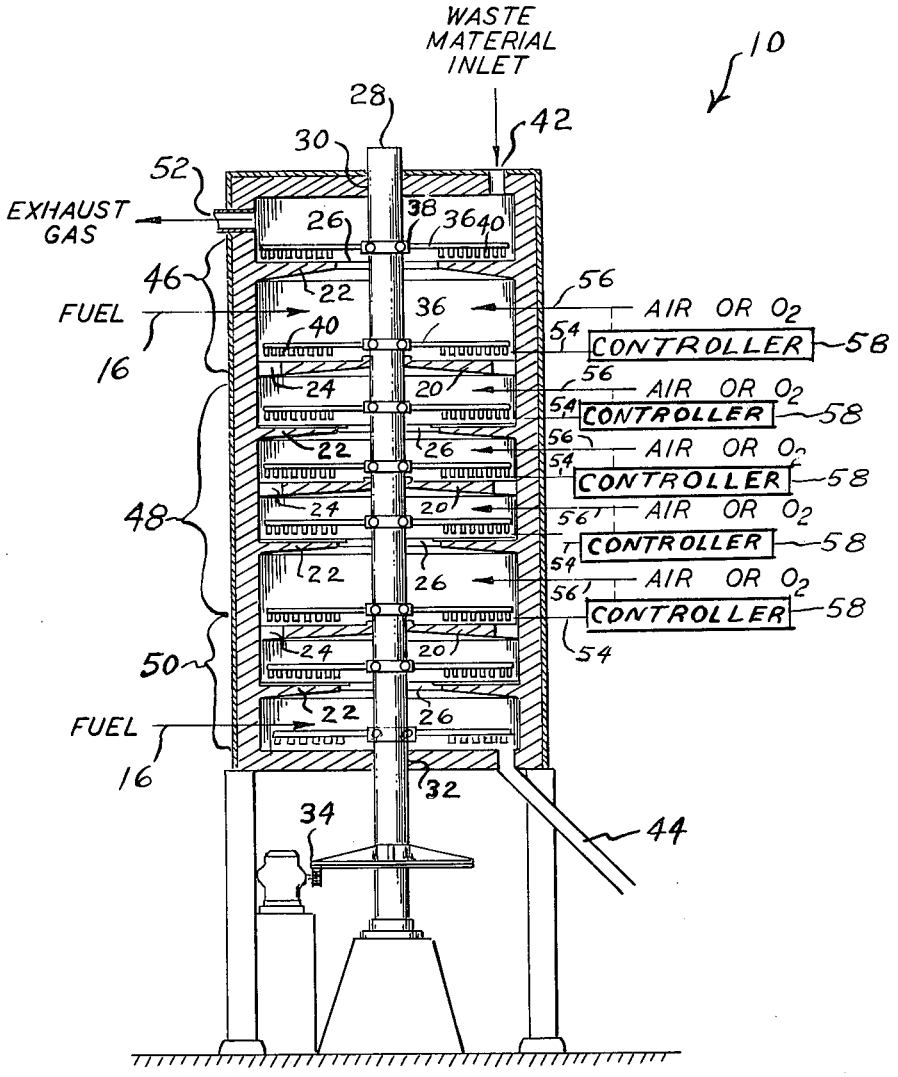
WASTE MATERIAL INLET
10
28
42
30
52
EXHAUST GAS
26
38
36
40
46
22
56
FUEL
40
36
AIR OR $O_2$
54
CONTROLLER
58
16
24
20
56
AIR OR $O_2$
54
CONTROLLER
58
22
26
56
AIR OR $O_2$
54
CONTROLLER
58
48
24
20
56
AIR OR $O_2$
CONTROLLER
58
54
22
26
AIR OR $O_2$
56
CONTROLLER
58
50
24
20
54
FUEL
22
26
16
32
34
44

TREATMENT OF WASTE MATERIAL CONTAINING ALKALI METALS IN A CONTROLLED ATMOSPHERE FURNACE

BACKGROUND OF THE INVENTION

This invention relates to the treatment of waste material, and more particularly to treating waste material containing alkali metals such as sodium and potassium, in a controlled atmosphere furnace. The invention is particularly adapted, among other possible uses, for treating sewage sludge, municipal, industrial or community garbage, trash or refuse, for example.

It is desirable to treat waste material, which contains alkali metals such as sodium and potassium in a furnace in order to reduce the volume thereof, free the volatiles and to put it in a stable, non-putridable organic form, which is suitable for such purposes as land fill, for example. Heretofore, attempts have been made to burn the carbon contained in such waste material at a low temperature, but difficulties were experienced due to the formation of slag in the furnace, which tended to fuse and attack the furnace brick work, as well as causing rabbling problems in multiple hearth furnaces.

The present invention is directed to a method for overcoming the foregoing problems in a new and improved manner, as will become apparent as the description proceeds.

SUMMARY OF THE INVENTION

In order to accomplish the desired results, the invention provides, in one form thereof, a new and improved method for treating waste material containing alkali metals in a counter-flow furnace wherein the waste material to be processed is introduced at one end of the furnace and the processed material is discharged from the other. Simultaneously, air is introduced to the furnace and the gases of combustion are caused to flow in counter-current direction with respect to the material being processed and are exhausted at the first end thereof. This furnace has a natural tendency to form zones of processing including sequentially from the first end of the furnace to the other end thereof, a drying zone, a charring and volatile burning zone, and a fixed carbon burning zone. The method further includes the step of maintaining a maximum temperature in the furnace below about 1400° F. directly adjacent the surface of the bed of material being processed. Preferably, this temperature is maintained below about 1300° F. Further, according to one aspect of the invention the temperature is maintained within a range of from about 1200° F. to about 1400° F. and preferably between about 1200° F. and about 1300° F.

According to another aspect of the invention, the alkali metals are sodium and potassium. Further, according to still another aspect, the processing in the fixed carbon burning zone is terminated prior to the burning of all of the fixed carbon. As still an additional aspect thereof, air is added to the furnace in the charring and volatile burning and in the fixed carbon burning zones in a quantity below that theoretically required for complete combustion.

In another form of the invention, the counter-flow furnace is a multiple hearth furnace, having a plurality of vertically spaced hearths, a rotatable center shaft extending through the center of the furnace and passing through each hearth. A plurality of spaced rabble arms are secured to the center shaft and extend radially outwardly over each hearth, alternate hearths having drop holes disposed towards the center shaft and the other hearths having drop holes disposed toward the outer periphery thereof. The furnace has an upper material inlet and a lower material dispensing outlet, as well as an upper exhaust gas outlet. In addition means are disposed on successive hearths for ascertaining the temperature on that hearth below about 1400° F. According to an aspect of the invention, the means for maintaining the maximum temperature comprises air supply means and a controller for adding only enough air to each hearth to maintain the temperature on that hearth under about 1400° F.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which the disclosure is based may readily be utilized as a basis for the designing of other methods and apparatus for carrying out the several purposes of the invention. It is important, therefore, that the claims be regarded as including such equivalent methods and apparatus as do not depart from the spirit and scope of the invention.

Specific embodiments of the invention have been chosen for purposes of illustration and description, and are shown in the accompanying drawing, forming a part of the specification.

BRIEF DESCRIPTION OF THE DRAWING

The FIGURE is a diagrammatic illustration, partially in axial, sectional elevation of a system for treating waste material containing alkali metals in a controlled atmosphere furnace, in accordance with the concepts of my invention.

DETAILED DESCRIPTION OF THE PREFERRED EMBODIMENTS

The drawing illustrates a multiple hearth furnace, which is suitable for carrying out the purposes of the invention. The multiple hearth furnace, indicated generally at 10, is of cylindrical configuration. Such a furnace may be of the type, for example, as described in detail in U.S. Pat. No. 3,905,757 issued Sept. 16, 1975. Thus, the furnace is constructed of a tubular outer steel shell 12, which is lined with fire brick or other similar heat resistant material 14. The furnance is provided with a plurality of burner nozzles 16, with one or more being provided on one or more of the hearths, as necessary, for initial start-up operation and for controlling the temperatures within the different regions of the furnace to carry out the particular processing desired. Any suitable type of fuel may be provided to these burners.

The interior of the furnace 10 is divided, by means of hearth floors 20 and 22, into a plurality of vertically aligned hearths, the number of hearths being preselected depending on the particular process being carried out. Each of the hearth floors is made of refractory material and is preferably of slightly arched configuration in order to be self-supporting within the furnace. Outer peripheral drop holes 24 are provided near the outer shell 12 of the furnace, and central drop holes 26 are formed in alternate hearth floors 22, near the center of the furnace. While the drawing shows the uppermost, or first, hearth as being an in-flow hearth, it will be appreciated that the concepts of the invention apply equally well to a furnace having an out-flow first hearth.

In the system illustrated in the drawing, a rotatable center shaft 28 extends axially through the furnace 10 and is secured by upper bearing means indicated at 30 and lower bearing means 32. This center drive shaft is rotatably driven by an electric motor and gear drive 34, provided for the purpose. A plurality of spaced rabble arms 36 are mounted on the center shaft 28, as at 38, and extend outwardly in each hearth over the hearth floor. The rabble arms have rabble teeth 40 formed thereon, which extend downwardly nearly to the hearth floor. The rabble teeth are inclined with respect to the longitudinal axis of their respective rabble arms so that as the rabble arms 36 are carried around by the rotation of the center shaft 28, the rabble teeth 40 continuously rake through the material being processed on the associated hearth floor and gradually urge the material toward the drop holes 24 and 26 in the hearth floors.

The material to be processed enters the top of the furnace at an inlet 42 and passes downwardly through the furnace in a generally serpentine fashion alternately inwardly and outwardly across the hearths and is discharged at the bottom of the furnace, as indicated at 44. The material may then be passed to a quencher, or the like (not shown).

In effect, the furnace is divided into three zones. However, the zones are not finely segregated, but vary depending on the characteristics of the material being processed. Thus, the first or upper zone 46, consisting of the first several hearths is a drying zone, and the second zone 48 consisting of the next several hearths is a charring and volatile burning zone. The third zone 50 is a fixed carbon burning zone.

The exhaust gases from the furnace are discharged from an outlet 52 at the top of the furnace and may be passed to other processing devices such as a wet scrubber, for example.

As pointed out hereinbefore, it is desirable to convert organic or carbon waste into a form, which is suitable for such purposes as land fill, for example. In many installations such waste material contains small quantities of alkali metals such as sodium and potassium, which are particularly difficult to treat in a furnace. Thus, in order to reduce the waste material to a usable form, the volatiles are burned off and the carbon is charred, as indicated in zone 48 of the drawing. Heretofore, attempts were made to burn the carbon waste at low temperatures, but difficulties were experienced due to the formation of slag, which attacked the furnace brick work. In view of these problems, I have made an extensive analysis of the factors which contributed to such slag formation, and have actually found a method and apparatus which accomplishes the desired results without such slag being formed. Heretofore, it was conventional to measure the temperature of a hearth in the air-gas region, a substantial distance above the bed. However, I have found that, while the thermocouples in such a region might indicate a satisfactory temperature, the actual temperature in the bed is frequently substantially higher, thereby causing slagging. Conventionally, the prior art installations operated with a substantial excess of air, which was presummed to cool the operation due to its smothering effect. However, I have found that such excess air instead aggrevated the problem because, while the air-gas region might be cooled, the added oxygen at the bed surface actually increased the combustion rate and overheating occurred in local zones at the bed surface.

According to the invention, I mount the temperature sensing device, or thermocouple directly adjacent the bed surface, as indicated at 54 in the drawing. Preferably, according to the invention, I operate the furnace in a oxygen deficient condition. Methods and appaartus for operating in a oxygen deficient condition are explained in detail in my copending patent application entitled "Method and Apparatus for Incinerating Waste Material" filed on the same date as the present application. Thus, one or more air nozzle 56 are provided for particular hearths, as necessary. The flow of air through the nozzle is controlled by a controller 58, which has an input from the temperature sensor 54. In operation, at each successive hearth, the temperature thereof is ascertained by the temperature sensor and the controller only allows enough air to enter that hearth, as is required to maintain the preselected temperature.

Moreover, I have found that certain maximum and minimum temperature limitations are critical for obtaining the desired results. Thus, I have found that the maximum temperature is of the order of about 1400° F. and preferably the maximum temperature is maintained below about 1300° F. In order to remove the volatiles, the minimum temperature is of the order of about 1200° F.

In order to better explain the invention, the following test data is set forth:

EXAMPLE 1

The material was a black liquor with viscosity judged to be only moderately greater than water. Specific gravity was 1.25. No settling or modification on standing was observed. The sample contained 38% solids, the solids being equal parts of NaOH and organics.

150 cc. of liquor were slowly boiled down and carbonized at 1200° F. in large covered crucibles. The yield was 47 grams of black crisp solids. The 47 grams of solids were mixed with water and a 2.7 gram carbon residue obtained, indicating 44.3 grams soluble salts. The carbon residue weight is not significant as it is perfectly possible that some fixed carbon was oxidized. The weight of soluble matter corresponds to 19% NaOH in the original, converted to $Na_2CO_3$. Various other samples were carbonized at temperatures of 1200° to 1500° F. Carbonization above 1400° F. resulted in partial fusion into the crucibles.

EXAMPLE 2

The same material as that employed in example 1 was used. The material was carbonized in an 18 inch Herreshoffing unit with the following results:

| Elapsed Time-Minutes | React'n Chamb. Temp.-Deg. F. | Air/Fuel Ratio | Remarks |
|---|---|---|---|
| Run 1 | | | |
| 0 | 450 | 14.4 | Rabbling well |
| 75 | 900 | 13.2 | |
| 120 | 1000 | 13.2 | |
| 135 | 1075 | 13.2 | |
| 180 | 1225 | 12.0 | Rabbling good |
| 225 | 1320 | 12.0 | |
| 255 | 1300 | 12.0 | |
| 315 | 1250 | 12.0 | Even rabble |
| 330 | 1310 | 36.0 | |
| 360 | 1350 | 36.0 | $Na_2CO_3$ sticking to rabble arms slightly |

-continued

| Elapsed Time-Minutes | React'n Chamb. Temp.-Deg. F. | Air/Fuel Ratio | Remarks |
|---|---|---|---|
| 390 | 1350 | 32.4 | |
| 405 | 1350 | 32.4 | |
| 480 | 1375 | 32.4 | |
| Run 2 | | | |
| 0 | 100 | 27.8 | |
| 45 | 790 | 22.6 | |
| 120 | 970 | 18.5 | |
| 135 | 1100 | 18.5 | Smooth rabble |
| 180 | 1320 | 18.5 | |
| 190 | 1330 | 27.8 | |
| 215 | 1300 | 27.8 | |
| 235 | 1350 | 26.6 | Material rabbling at full capacity |
| 285 | 1350 | 26.6 | |
| Run 3 | | | |
| 0 | 650 | 19.3 | |
| 45 | 860 | 19.3 | |
| 60 | 890 | 18.5 | |
| 105 | 1130 | 18.5 | |
| 150 | 1290 | 18.5 | Smooth rabble-no stickiness |
| 155 | 1310 | 25.9 | |
| 165 | 1275 | 29.5 | |
| 210 | 1280 | 24 | |
| 225 | 1300 | 24 | |
| 227 | 1300 | 24 | Bed starting to burn |
| 230 | 1400 | 29.5 | |
| 240 | 1400 | 29.5 | $Na_2CO_3$ seems to stick to wall side |
| 270 | 1300 | 32.4 | |
| 280 | 1470 | 32.4 | Dry material adhering to side - Fushion starting |
| 330 | 1300 | 32.4 | Necessary to break down large particles from high temp. fusing to promote good rabble |
| 345 | 1250 | 32.4 | |
| 350 | 1300 | 32.4 | Not rabbling well |
| 385 | 1253 | 32.4 | |
| 397 | 1300 | 32.4 | |

It will thus be seen from the above example 1 that satisfactory results were obtained between a temperature range of from 1200° to 1400° F. and that above 1400° F. partial fusion occurred. Example 2, runs 1 and 2 showed satisfactory results up to temperature of about 1350° F. to 1375° F. However, in run 1 it is noted that at one point 1350° F. it was observed that $Na_2CO_3$ was sticking slightly to the rabble arm. Run 3 shows unsatisfactory results when the temperature ran as high as 1470° F., as it was necessary to break down the large particles from high temperature fusing in order to promote good rabbling.

In addition, it has been found desirable to terminate the operation before all of the fixed carbon has been burned away in the fixed carbon burning zone 50. That is, it is necessary to complete the charring and volatile burning stage 48 and to enter the fixed carbon burning stage 50, but the operation should be completed before all of the fixed carbon is burned. This is to prevent excess free oxygen from appearing adjacent the surface of the bed.

It will thus be seen that the present invention does indeed provide an improved system for treating waste material containing alkali metals in a controlled atmosphere furnace, which is superior in operability and reliability, as compared to prior art such systems.

Having thus described the invention with particular reference to the preferred forms thereof, it will be obvious to those skilled in the art to which the invention pertains, after understanding the invention that various changes and modifications may be made therein without departing from the spirit and scope of the invention, as defined by the claims appended hereto.

What is claimed is:

1. A method of treating waste material containing alkali metals in a counter-flow furnace wherein waste material to be processed is introduced at one end thereof and the processed material is discharged from the other end thereof, while simultaneously air is introduced and the gases of combustion are caused to flow in counter-current direction with respect to the material being processed and are exhausted at said one end of the furnace, and wherein the furnace has a natural tendency to form zones of processing including sequentially from said one end of the furnace, a drying zone, a charring and volatile burning zone, and a fixed carbon burning zone, said method further comprising the step of maintaining a maximum temperature in the furnace below about 1400° F. directly adjacent the surface of the bed of material being processed.

2. A method of treating waste material containing alkali metals in a counter-flow furnace according to claim 1 wherein said temperature is maintained below a temperature of the order of about 1300° F.

3. A method of treating waste material containing alkali metals in a counter-flow furnace according to claim 1 wherein said temperature is maintained in a range of from about 1200° F. to about 1400° F.

4. A method of treating waste material containing alkali metals in a counter-flow furnace according to claim 1 wherein said temperature is maintained in a range of from about 1200° F. to about 1300° F.

5. A method of treating waste material containing alkali metals in a multiple hearth furnace having a plurality of vertically spaced hearths, wherein waste material is introduced to the furnace at the top thereof and moves downwardly in a generally serpentine fashion alternately inwardly and outwardly across the hearths and is discharged at the bottom of the furnace, while simultaneously air is introduced thereto towards the bottom of the furnace and the gases of combustion are caused to flow in counter-current direction with respect to the material being processed and are exhausted at the top of the furnace, and wherein the furnace has a natural tendency to form zones of processing including sequentially from the top of the furnace to the bottom thereof, a drying zone, a charring and volatile burning zone, and a fixed carbon burning zone, said method further comprising the step of maintaining a maximum temperature in the furnace below about 1400° F. directly adjacent the surface of the bed of material being processed.

6. A method of treating waste material containing alkali metal in a furnace according to claim 5 wherein air is added to said furnace in the fixed carbon burning and in the charring and volatile burning zones in a quantity below that theoretically required for complete combustion.

7. A method of treating waste material containing alkali metals in a multiple hearth furnace according to claim 5 wherein the processing in the fixed carbon burning zone is terminated prior to burning all of the fixed carbon.

8. A method of treating waste material containing alkali metals in a multiple hearth furnace according to claim 5 wherein said alkali metals are sodium and potassium.

9. Apparatus for treating waste material containing alkali metals comprising, in combination, a multiple hearth furnace having a plurality of vertically spaced hearths, a rotatable center shaft extending through the center of the furnace and passing through each hearth, a plurality of spaced rabble arms secured to the center shaft and extending radially outwardly over each hearth, alternate hearths having drop holes disposed towards the center shaft and the other hearths having drop holes disposed toward the outer periphery thereof, said furnace having an upper material inlet and a lower material dispensing outlet, and said furnace having an upper exhaust gas outlet, means disposed on successive hearths in said furnace for ascertaining the temperature at each hearth and means for maintaining a maximum temperature on that hearth below about 1400° F.

10. Apparatus for treating waste material containing alkali metals according to claim 9 wherein said means for maintaining a maximum temperature comprises air supply means and controller means for adding only enough air to each hearth to maintain the temperature on that hearth under said 1400° F.

* * * * *